US005951280A

United States Patent [19]

Kubota

[11] Patent Number: 5,951,280

[45] Date of Patent: Sep. 14, 1999

[54] HIGH-TEMPERATURE REGENERATOR

[75] Inventor: Norikazu Kubota, Gunma-ken, Japan

[73] Assignee: Sanyo Electric Co., Ltd., Osaka-fu, Japan

[21] Appl. No.: 09/005,413

[22] Filed: Jan. 9, 1998

[30] Foreign Application Priority Data

Jan. 10, 1997 [JP] Japan ..... 9-2954

[51] Int. Cl.[6] ..... F27D 17/00

[52] U.S. Cl. ..... 432/180; 62/497

[58] Field of Search ..... 432/222, 180; 62/474, 476, 497

[56] References Cited

U.S. PATENT DOCUMENTS 4,487,036 12/1984 Itoh et al. ..... 62/474

5,832,742 11/1998 Kouri et al. ..... 62/497

*Primary Examiner*—Teresa Walberg

*Assistant Examiner*—Gregory A. Wilson

*Attorney, Agent, or Firm*—Weingarten, Schurgin, Gagnebin & Hayes LLP

[57] ABSTRACT

In a high-temperature regenerator of an absorption refrigerator according to the present invention, the longitudinal cross-sectional area of a portion of a combustion chamber parallel to the surface combustion plate is given a shape that is narrowed to a size equal to the surface area of the fire hole towards the downstream side from a surface combustion plate. As a result, a pipe wall of the combustion chamber protects the vicinity of the fire hole. Since this pipe wall contains absorption fluid flowing through it in the form of convection flow, it does not reach high temperatures as in the refractory material of the prior art, thereby being able to avoid the problem of increased NOx values. In addition, the problem of the prior art of inhibiting heat transfer to pipe wall is also eliminated.

6 Claims, 4 Drawing Sheets

PRIOR ART

HIGH-TEMPERATURE REGENERATOR

BACKGROUND OF THE INVENTION

1. Field of the Invention

The present invention relates to a high-temperature regenerator of an absorption refrigerator, and more particularly, to the structure of a high-temperature regenerator that uses a surface combustion apparatus for the heating apparatus.

2. Background Art

An explanation of the general outline of an absorption refrigerator using a high-temperature regenerator of the prior art is given in FIG. 3.

In the drawing, reference numeral 1 is an evaporator/absorber drum (a lower drum). An evaporator 2 and an absorber 3 are housed in this evaporator/absorber drum 1. Reference numeral 4 is the high-temperature regenerator as claimed in this embodiment, which is equipped with a burner 5. An absorption fluid pump P, a low-temperature heat exchanger 7 and a high-temperature heat exchanger 8 are provided intermediately in diluted absorption fluid piping 6 extending from the absorber 3 to the high-temperature regenerator 4.

Reference numeral 10 is a high-temperature drum (an upper drum), and a low-temperature regenerator 11 and a condenser 12 are housed within this high-temperature drum 10. Reference numeral 13 is a refrigerant vapor pipe extending from the high-temperature regenerator 4 to the low-temperature regenerator 11, reference numeral 16 is a refrigerant fluid flow down pipe extending from the condenser 12 to the evaporator 2, reference numeral 17 is a refrigerant circulating pipe connected to the evaporator 2, and reference numeral 18 is a refrigerant pump. Reference numeral 21 is a cold water pipe connected to the evaporator 2.

Reference numeral 22 is an intermediate absorption fluid pipe extending from the high-temperature regenerator 4 to the high-temperature heat exchanger 8, and reference numeral 23 is an intermediate absorption fluid pipe extending from the high-temperature heat exchanger 8 to the low-temperature regenerator 11. Reference numeral 25 is a condensed absorption fluid pipe extending from the low-temperature regenerator 11 to the low-temperature heat exchanger 7, and reference numeral 26 is a condensed absorption fluid pipe extending from the low-temperature heat exchanger 7 to the condenser 3. In addition, reference numeral 29 is a cooling water pipe.

During operation of the absorption refrigerator composed in the manner described above, the burner 5 of the high-temperature regenerator 4 burns causing dilute absorption fluid such as an aqueous lithium bromide solution (LiBr) (containing a surface active agent), which has flowed in from absorber 3, to be heated and boil resulting in separation of refrigerant vapor from the dilute absorption fluid. The dilute absorption fluid is concentrated as a result of this operation.

The refrigerant vapor flows to the low-temperature regenerator 11 through the refrigerant vapor pipe 13. Intermediate absorption fluid from the high-temperature regenerator 4 is heated in the low-temperature regenerator 11, and the condensed refrigerant fluid flows to the condenser 12. In the condenser 12, the refrigerant vapor that has flowed in from the low-temperature regenerator 11 condenses and flows down to the evaporator 2 with the refrigerant fluid that has flowed in from the low-temperature regenerator 11.

In the evaporator 2, the refrigerant fluid is disseminated due to the operation of the refrigerant pump 18. Cold water, the temperature of which has been lowered as a result of cooling by this dissemination, is supplied to the load. The refrigerant vapor that has vaporized in the evaporator 2 flows to the absorber 3 where it is absorbed by the above-mentioned disseminated absorption fluid.

On the other hand, the intermediate absorption fluid, the concentration of which has increased following separation of the refrigerant vapor in the high-temperature regenerator 4, flows to the low-temperature regenerator 11 after passing through the intermediate absorption fluid pipe 22, the high-temperature heat exchanger 8 and the intermediate absorption fluid pipe 23.

The intermediate absorption fluid is heated by a heater 14 through which the refrigerant vapor from the high-temperature regenerator 4 flows. The concentration of the absorption fluid is further increased following separation of the refrigerant vapor from said intermediate absorption fluid.

Concentrated absorption fluid that has been heated and concentrated in the low-temperature regenerator 11 flows into the condensed absorption fluid pipe 25 and then flows to the absorber 3 after passing through the low-temperature heat exchanger 7 and the condensed absorption fluid pipe 26 followed by dripping onto the cooling water pipe 29 from a dissemination apparatus 30. The concentration of the refrigerant increases as a result of absorbing refrigerant vapor to be described later that enters through the evaporator 2. The absorption fluid having an increased refrigerant concentration is preheated in the low-temperature heat exchanger 7 and the high-temperature heat exchanger 8, and flows into the high-temperature regenerator 4 due to the driving force of the absorption fluid pump P.

Next, the following provides an explanation of the high-temperature regenerator 4.

As shown in FIG. 3, fuel 31, which is taken in towards the burner 5 of the high-temperature regenerator 4, and air, which is sent from a blower 33, are mixed and ignited to start combustion.

At this time, as shown in FIGS. 4A and 4B, air and fuel are mixed in an air-fuel mixture chamber 35 to form an air-fuel mixture. A surface combustion plate 37 is provided on the downstream side of the air-fuel mixture chamber 35. A large number of combustion holes through which the air-fuel mixture passes are provided in the surface combustion plate 37. An ignition device that ignites the air-fuel mixture and various types of sensors (not shown) that detect the combustion flame produced by ignition are provided in the vicinity of the surface combustion plate 37.

The air-fuel mixture chamber 35 and a combustion chamber 39 are connected with the surface combustion plate 37 in between. The periphery of the combustion chamber 39 is surrounded by pipe wall 41. Fluid pipe group 43 is continuous with the pipe wall 41, and absorption fluid flows through the inside of said fluid pipe group 43 in the form of convection flow.

In the case the surface area of a fire hole 45 formed by the boundary between the air-fuel mixture chamber 35 and the combustion chamber 39 is formed to be smaller than the longitudinal cross-sectional surface area of the air-fuel mixture chamber 35 and the combustion chamber 39 parallel to the surface combustion plate (see FIGS. 4A and 4B), it is necessary to cover the sites inside the chamber around the fire hole 45 with a refractory material 46 to protect the area around the fire hole 45 from the effects of the heat inside the chamber.

However, since it is necessary for the refractory material 46 which covers the fire hole 45 to be of a suitable thickness (for example, about 50 mm), it inhibits the transfer of heat to the pipe wall 41. Moreover, there is also the problem of increased NOx values due to the refractory material 46 reaching high temperatures.

In order to solve the above-mentioned problems, the object of the present invention is to provide a high-temperature regenerator that is able to avoid the problem of increased NOx values without inhibiting heat transfer.

SUMMARY OF THE INVENTION

In order to achieve the above-mentioned object, a first aspect of the present invention is to provide a high-temperature regenerator having: an air-fuel mixture chamber in which fuel and air are mixed to form an air-fuel mixture; a surface combustion plate provided on the downstream side of said air-fuel mixture chamber over which said air-fuel mixture passes; an ignition device that ignites said air-fuel mixture that has passed over said surface combustion plate; a combustion chamber connected to said air-fuel mixture chamber with said surface combustion plate in between, the periphery of which is surrounded by a pipe wall; and a fluid pipe group provided downstream from combustion gas in said combustion chamber, connected to said pipe wall and through which absorption fluid flows in the form of convection flow; wherein the surface area of a fire hole defined by the boundary between said air-fuel mixture chamber and the combustion chamber is smaller than the longitudinal cross-sectional surface area of said air-fuel mixture chamber and said combustion chamber parallel to the surface combustion plate, the shape of said combustion chamber is such that the longitudinal cross-sectional surface area of a portion of said combustion chamber parallel to the surface combustion plate is narrowed to a size equal to the surface area of said fire hole from said surface combustion plate towards the downstream side.

A second aspect of the present invention is to provide a high-temperature regenerator as set forth above wherein the portion of said narrowed combustion chamber is a portion that does not extend to said fluid pipe group from said surface combustion plate.

A third aspect of the present invention is to provide a high-temperature regenerator as set forth above wherein the portion of said narrowed combustion chamber is a portion that extends to a portion of said fluid pipe group from said surface combustion plate.

A fourth aspect of the present invention is to provide a high-temperature regenerator as set forth above having a structure wherein said air-fuel mixture chamber and said surface combustion plate are respectively and individually attached to said combustion chamber.

DETAILED DESCRIPTION OF THE PREFERRED EMBODIMENTS

Figure 1A:
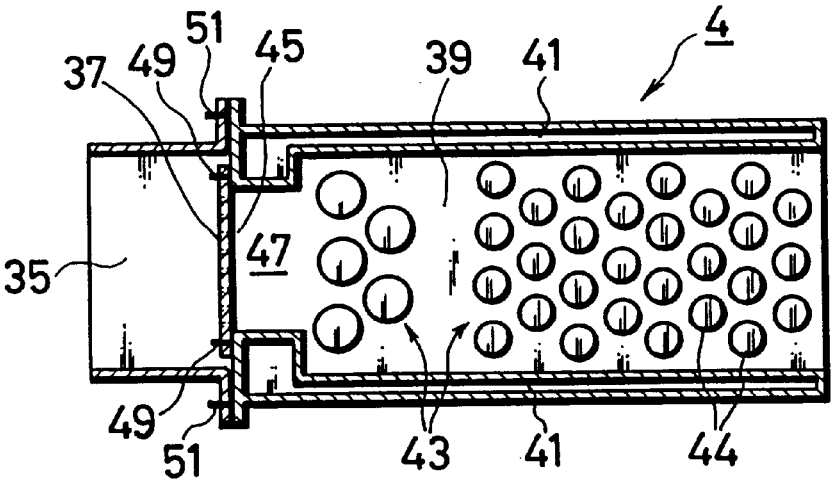
FIG. 1A is a horizontal cross-sectional view and FIG. 1B is a longitudinal cross-sectional side view showing a high-temperature regenerator as claimed in one embodiment of the present invention.
Figure 1B:
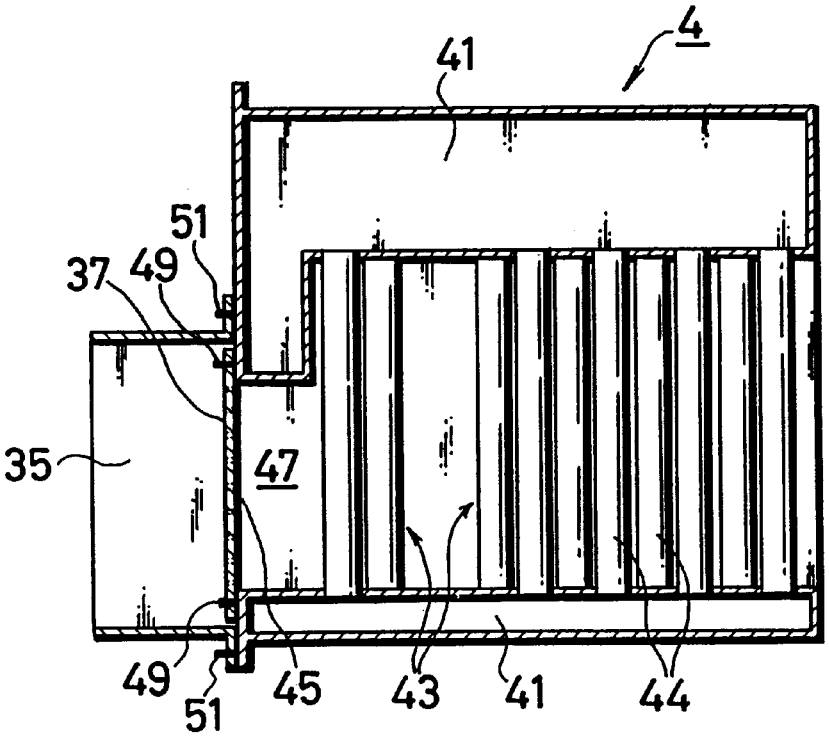
Figure 3:
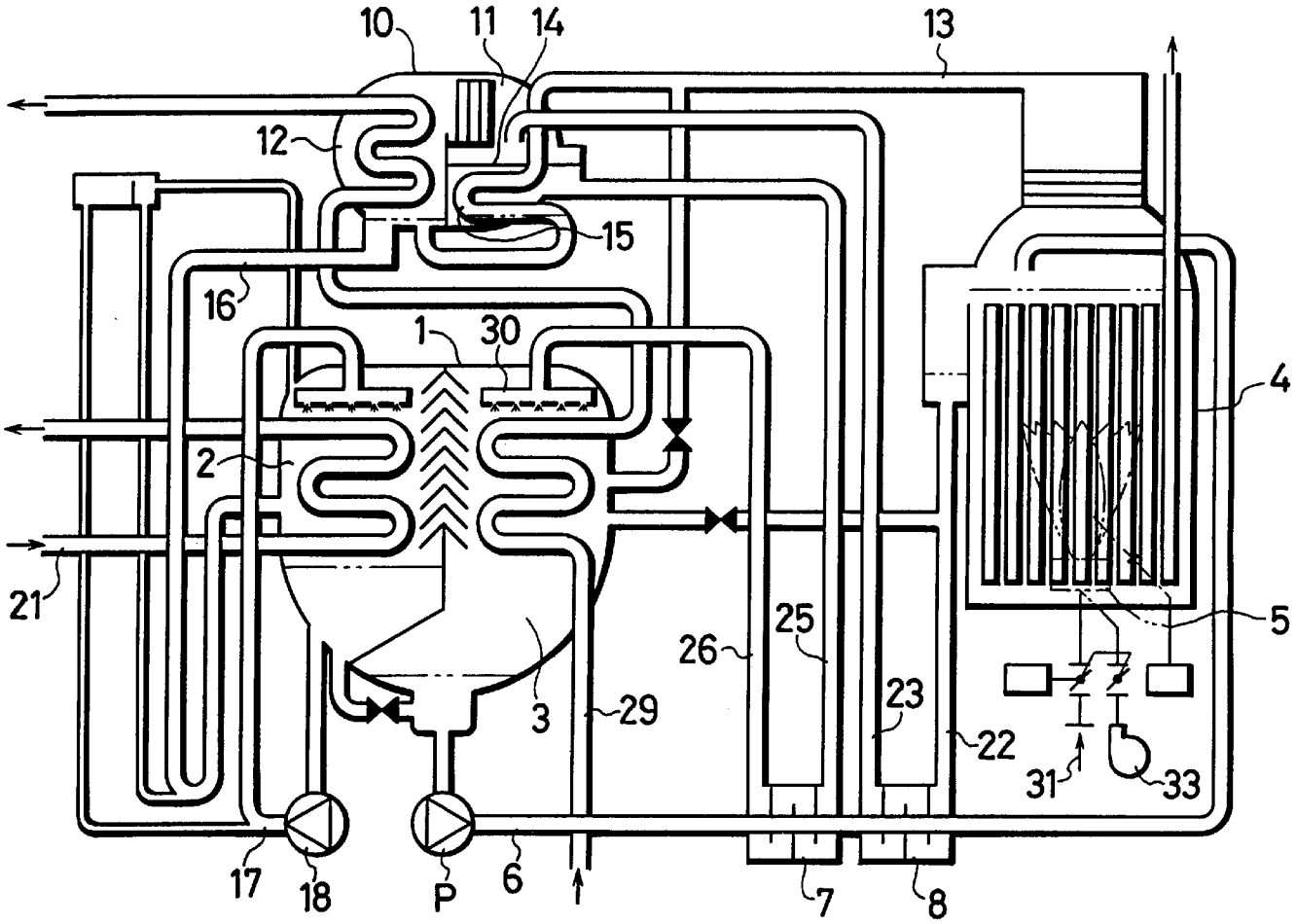
FIG. 3 is an overall circuit drawing of an absorption refrigerator having a high-temperature regenerator.
Figure 4A:
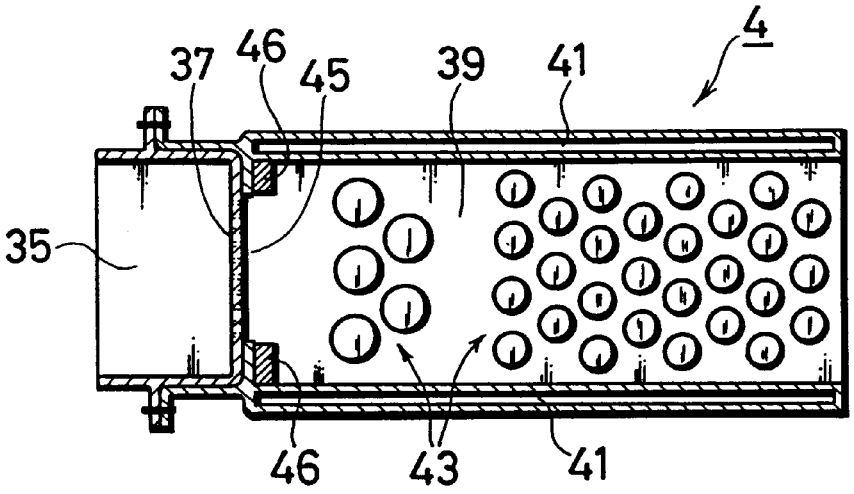
Fig. 4A Prior Art
FIG. 4A is a horizontal cross-sectional view and FIG. 4B is a longitudinal cross-sectional view showing a high-temperature regenerator of the prior art.
Figure 4B:
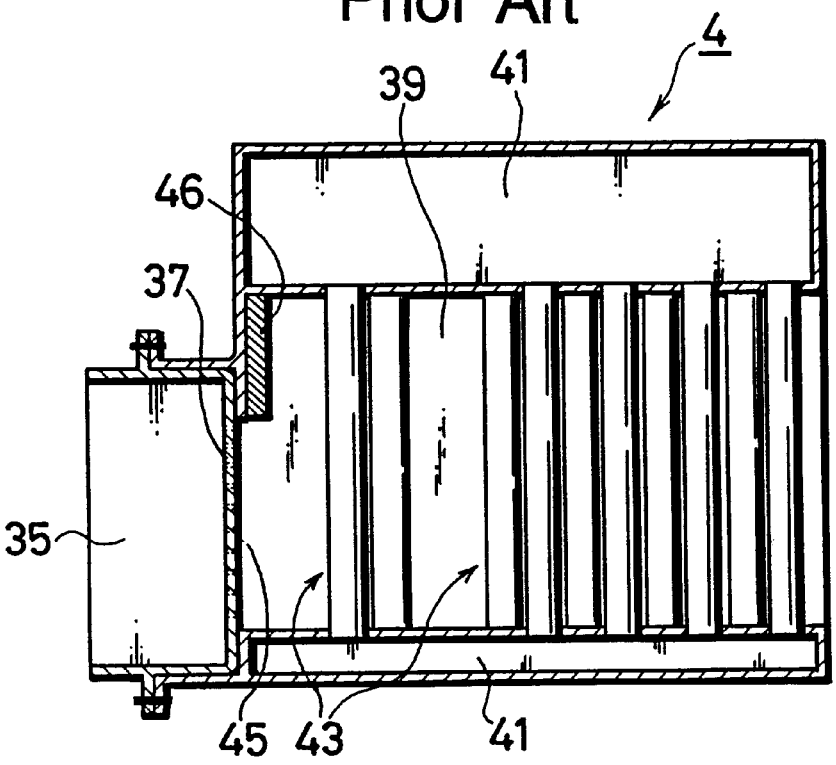
Fig. 4B Prior Art

A high-temperature regenerator as claimed in one embodiment of the present invention is shown in FIG. 1. Furthermore, the general outline of the absorption refrigerator itself is similar to that of the prior art shown in FIG. 3. Moreover, those portions having the same functions as in the prior art are indicated using the same reference numerals to facilitate easier understanding.

Fuel and air are mixed in the air-fuel mixture chamber 35 to form an air-fuel mixture. Consequently, the air-fuel mixture chamber 35 is composed to as to allow connection of a fuel supply pipe and an air supply pipe (not shown). These fuel supply and air supply pipes are equipped with valve apparatuses and so forth for adjusting the amounts of fuel and air.

The surface combustion plate 37 is provided on the downstream side of the air-fuel mixture chamber 35. A large number of combustion holes through which the air-fuel mixture passes are provided in the surface combustion plate 37. Although not shown in the drawings, an ignition device that ignites the air-fuel mixture and various types of sensors that detect the combustion flame produced by ignition are provided in the vicinity of the surface combustion plate 37.

The combustion chamber 39 is connected to the air-fuel mixture chamber 35 with the surface combustion plate 37 in between. The periphery of the combustion chamber 39 is surrounded by the pipe wall 41 having a double-layer construction. Fluid pipe group 43 is continuous with the pipe wall 41, and absorption fluid flows through the pipe wall 41 and each pipe 44 that composes fluid pipe group 43 in the form of convection flow.

The inside space of the double-layer construction protrudes considerably towards the inside of the combustion chamber on the upstream side of the pipe wall 41, namely in the vicinity of the fire hole 45. As a result, the surface area of the fire hole 45 is formed to be smaller than the longitudinal cross-sectional surface area of the air-fuel mixture chamber 35 and the combustion chamber 39 parallel to the surface combustion plate.

Thus, due to the presence of this protruding portion, this high-temperature regenerator has shape 47 in which the longitudinal cross-sectional surface area of a portion of the combustion chamber 39 parallel to the surface combustion plate is narrowed to a size equal to the surface area of the above-mentioned fire hole 45 towards the downstream side from the surface combustion plate 37. In addition, the fluid pipe group 43 and the pipe 44 are not provided at all in the portion of this narrowed shape 47. Namely, the portion of the narrowed shape 47 is a portion that does not extend to the fluid pipe group 43 from the surface combustion plate 37.

The surface combustion plate 37 is independently attached to the surface on the upstream side of the protruding portion of the pipe wall 41 by, e.g., bolts 49. The air-fuel mixture chamber 35 is independently attached by bolts 51 to the surface on the upstream side of the protruding portion of the pipe wall 41 at a site around the outside of the site at which the surface combustion plate 37 is attached. Thus, a structure is employed in which the air-fuel mixture chamber 35 and the surface combustion plate 37 are respectively and independently attached to the combustion chamber 39.

The following provides an explanation of the effects of the present embodiment.

Fuel and air, the amounts of which have been adjusted to the optimum proportions, are mixed in the air-fuel mixture chamber 35 to form an air-fuel mixture which then passes through the large number of combustion holes in the surface combustion plate 37. This air-fuel mixture is ignited and combustion is promoted by the action of the surface combustion plate 37.

The combustion flame and combustion gas passes through the fire hole 45 and heats absorption fluid flowing in the form of convection flow within the pipe wall 41 surrounding the combustion chamber 39 and the fluid pipe group 43.

As a result of employing the shape in which the longitudinal cross-sectional surface area of a portion of the combustion chamber 39 parallel to the surface combustion plate is narrowed to a size equal to the surface area of the above-mentioned fire hole towards the downstream side from the surface combustion plate 37, although the pipe wall 41 of the combustion chamber 39 protects the vicinity of the fire hole 45, since absorption fluid is flowing in the form of convection flow through the inside of this pipe wall 41, the pipe wall 41 has the function of a kind of water cooling screen. As a result, it does not reach high temperatures as in the refractory material of the prior art, thus being able to avoid the problem of increased NOx levels in the combustion gas.

In addition, since the vicinity of the fire hole 45 is comprised by the pipe wall 41, the problem of the prior art of inhibiting heat transfer to the pipe wall 41 is also eliminated.

Moreover, since the air-fuel mixture chamber 35 and the surface combustion plate 37 are independently attached to the combustion chamber 39 by the bolts 51 and 49, respectively, in comparison with the case in which the air-fuel mixture chamber 35 and the surface combustion plate 37 are both attached integrated into a single unit (FIG. 3) as in the prior art, maintenance and inspections as well as replacement work are easier, thereby allowing maintenance costs to be reduced.

Figure 2A:
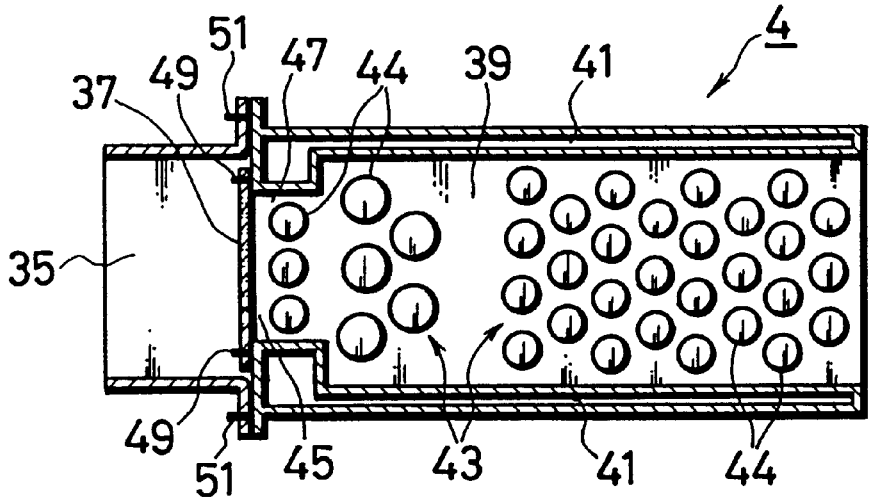
FIG. 2A is a horizontal cross-sectional view and FIG. 2B is a longitudinal cross-sectional side view showing a high-temperature regenerator as claimed in another embodiment of the present invention.
Figure 2B:
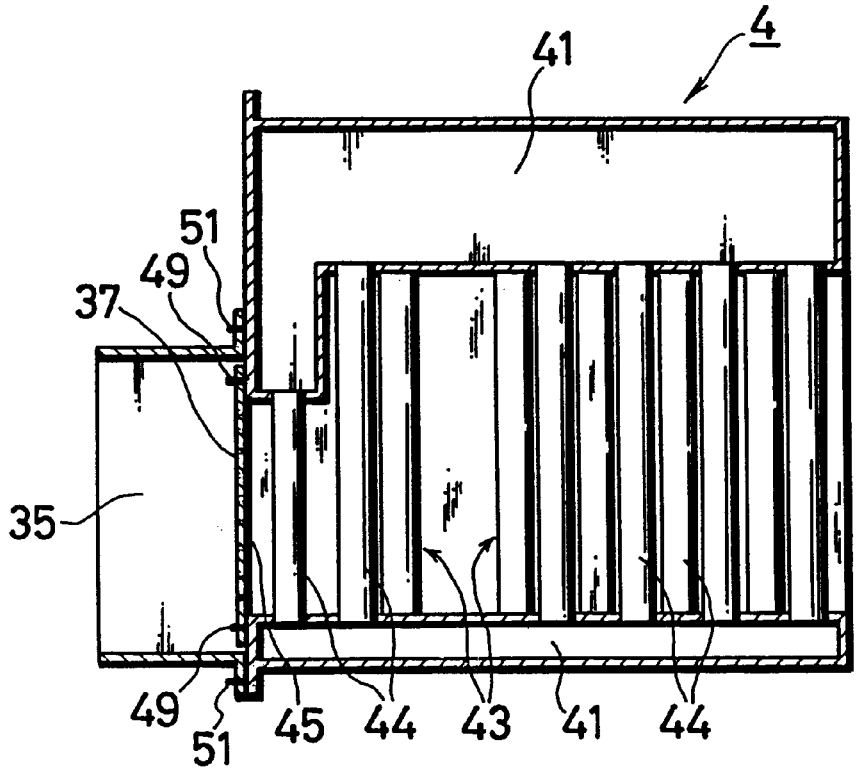

Although the portion of the narrowed shape 47 is a portion not extending to the fluid pipe group 43 from the surface combustion plate 37 in the above-mentioned embodiment, in another embodiment shown in FIG. 2, it may be a portion that extends to a portion of the fluid pipe group 43 from the surface combustion plate 37. Namely, the fluid pipe group 43 or the pipe 44 may be provided in the portion of the narrowed shape 47.

As a result of providing the fluid pipe group 43 or the pipe 44 in this manner, the vicinity of the fire hole 45 can be additionally prevented from reaching high temperatures, thereby more effectively avoiding the problem of increased NOx levels in the combustion gas.

As has been explained above, according to the present invention, by employing a shape in which the longitudinal cross-sectional surface area of a portion of a combustion chamber parallel to the surface combustion plate is narrowed to a size equal to the surface area of the above-mentioned fire hole towards the downstream side from a surface combustion plate, a pipe wall of the combustion chamber protects the vicinity of the fire hole. Since this pipe wall contains absorption fluid flowing through it in the form of convection flow, it does not reach high temperatures as in the refractory material of the prior art, thereby being able to avoid the problem of increased NOx values. In addition, the problem of the prior art of inhibiting heat transfer to the pipe wall is also eliminated.

In addition, since the air-fuel mixture chamber and surface combustion plate are respectively and independently attached to the combustion chamber, maintenance and inspections as well as replacement work are easier, thereby making it possible to reduce maintenance costs.

What is claimed is:

1. A high temperature regenerator of an absorption refrigerator having: an air-fuel mixture chamber in which fuel and air are mixed to form an air-fuel mixture; a surface combustion plate provided on the downstream side of said air-fuel mixture chamber over which said air-fuel mixture passes; an ignition device that ignites said air-fuel mixture that has passed over said surface combustion plate; a combustion chamber connected to said air-fuel mixture chamber with said surface combustion plate in between, the periphery of which is surrounded by a pipe wall; and a fluid pipe group provided downstream from combustion gas in said combustion chamber, connected to said pipe wall and through which absorption fluid flows in the form of convection flow; wherein the surface area of a fire hole defined by the boundary between said air-fuel mixture chamber and combustion chamber is smaller than the longitudinal cross-sectional surface area of said air-fuel mixture chamber and said combustion chamber parallel to the surface combustion plate, the shape of said combustion chamber is such that a portion of said combustion chamber is narrowed to a size equal to the surface area of said fire hole from said surface combustion plate towards the downstream side, the narrow portion of said side wall surrounded by said pipe wall.

2. A high-temperature regenerator as set forth in claim 1 wherein the portion of said narrowed combustion chamber is a portion that does not extend to said fluid pipe group from said surface combustion plate.

3. A high-temperature regenerator as set forth in claim 2 having a structure wherein said air-fuel mixture chamber and surface combustion plate are respectively and individually attached to said combustion chamber.

4. A high-temperature regenerator as set forth in claim 1 wherein the portion of said narrowed combustion chamber is a portion that extends to a portion of said fluid pipe group from said surface combustion plate.

5. A high-temperature regenerator as set forth in claim 4 having a structure wherein said air-fuel mixture chamber and surface combustion plate are respectively and individually attached to said combustion chamber.

6. A high-temperature regenerator as set forth in claim 1 having a structure wherein said air-fuel mixture chamber and surface combustion plate are respectively and individually attached to said combustion chamber.

* * * * *